US011085153B2

(12) United States Patent
Ninni

(10) Patent No.: US 11,085,153 B2
(45) Date of Patent: Aug. 10, 2021

(54) METHOD FOR MANUFACTURING A RAILWAY TRACK SUPPORT, ASSOCIATED RAILWAY TRACK SUPPORT AND RAILWAY INSTALLATION

(71) Applicant: ALSTOM Transport Technologies, Saint-Ouen (FR)

(72) Inventor: Andrea Ninni, Paris (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 579 days.

(21) Appl. No.: 15/995,259

(22) Filed: Jun. 1, 2018

(65) Prior Publication Data

US 2018/0347119 A1 Dec. 6, 2018

(30) Foreign Application Priority Data

Jun. 1, 2017 (FR) ..... 17 54867

(51) Int. Cl.

| | |
|---|---|
| ***E01B 3/38*** | (2006.01) |
| ***E01B 1/00*** | (2006.01) |
| ***E01B 3/42*** | (2006.01) |
| ***E01B 29/32*** | (2006.01) |
| ***B28B 1/08*** | (2006.01) |
| ***B28B 23/00*** | (2006.01) |

(Continued)

(52) U.S. Cl.

CPC ..... *E01B 3/38* (2013.01); *B28B 1/084* (2013.01); *B28B 23/0062* (2013.01);

(Continued)

(58) Field of Classification Search

CPC ... E01B 3/38; E01B 3/42; E01B 1/002; E01B 1/004; E01B 29/32; E01B 31/24;

(Continued)

(56) References Cited

U.S. PATENT DOCUMENTS 2,844,325 A * 7/1958 Weber ..... E01B 9/28 238/7
4,232,822 A * 11/1980 Hahn ..... E01B 1/004 104/11

(Continued)

FOREIGN PATENT DOCUMENTS

| | | |
|---|---|---|
| EP | 0803609 | 10/1997 |
| EP | 2351884 | 8/2011 |
| GB | 976311 | 11/1964 |

OTHER PUBLICATIONS

Preliminary Search Report for FR 1754867, dated Feb. 16, 2018.

*Primary Examiner* — Jason C Smith

(74) *Attorney, Agent, or Firm* — B. Aaron Schulman, Esq.; Stites & Harbison, PLLC

(57) ABSTRACT

This method for manufacturing a railway track support comprising a plurality of prefabricated elements (28) comprises the following successive steps:

providing, in a production zone (16) for prefabricated elements (28) located near an installation zone (14), a movable insertion machine (52) configured to arrange at least one insert (34) in a fresh concrete block, the production zone being separate from the installation zone;

pouring and shaping fresh concrete in order to form individual fresh concrete blocks having predetermined dimensions;

arranging at least one insert in each fresh concrete block using the movable insertion machine (52);

drying the fresh concrete blocks to obtain the prefabricated elements (28).

10 Claims, 3 Drawing Sheets

(51) Int. Cl.
*E01B 31/24* (2006.01)
*E01B 31/26* (2006.01)

(52) U.S. Cl.
CPC ..... *E01B 1/002* (2013.01); *E01B 3/42* (2013.01); *E01B 29/32* (2013.01); *E01B 31/24* (2013.01); *E01B 31/26* (2013.01); *E01B 1/004* (2013.01); *E01B 2201/04* (2013.01)

(58) Field of Classification Search
CPC ..... E01B 31/26; E01B 2201/04; B28B 1/084; B28B 23/0062
See application file for complete search history.

(56) References Cited

U.S. PATENT DOCUMENTS 4,290,991 A * 9/1981 Thim ..... B28B 23/005 264/157
4,737,333 A * 4/1988 Matthynssens ..... B28B 23/005 264/251
4,781,875 A * 11/1988 Jantzen ..... B28B 13/06 238/1
7,428,778 B2 * 9/2008 Milesi ..... E01B 29/32 33/1 G
2010/0320279 A1 * 12/2010 Miguelez Tapia ..... E01B 1/002 238/2
2014/0001667 A1 * 1/2014 Kang ..... B28B 1/29 264/40.5
2014/0183271 A1 * 7/2014 Hughes ..... E01B 19/00 238/2
2015/0376843 A1 * 12/2015 Cox ..... E01B 9/28 238/297
2016/0319962 A1 * 11/2016 Zhan ..... F16L 1/038
2018/0080177 A1 * 3/2018 Vastmans ..... E01B 26/00
2018/0347119 A1 * 12/2018 Ninni ..... E01B 3/38

* cited by examiner

METHOD FOR MANUFACTURING A RAILWAY TRACK SUPPORT, ASSOCIATED RAILWAY TRACK SUPPORT AND RAILWAY INSTALLATION

CROSS-REFERENCE

This claims the benefit of French Patent Application FR 17 54867, filed Jun. 1, 2017 and hereby incorporated by reference herein.

TECHNICAL FIELD OF THE INVENTION

The present invention relates to a method for manufacturing a railway track support comprising a plurality of prefabricated elements with predetermined dimensions assembled to one another.

The present invention also relates to a railway track support produced by carrying out such a method and an associated railway installation.

BACKGROUND OF THE INVENTION

Documents EP 2 351 884 A1 and GB 976 311 A1 disclose methods for manufacturing a railway track support consisting of arranging, side by side, on prepared ground, a series of prefabricated concrete modules.

Such methods are complex, costly and time-consuming to carry out. They in particular do not allow rapid manufacturing of the track, replication in the plant of the outline of the railway track as expected on the construction site, and optimized linking in terms of time and logistics of the manufacturing steps.

The invention aims to offset the aforementioned problems.

SUMMARY OF THE INVENTION

To that end, the invention relates to a manufacturing method of the aforementioned type, comprising the following successive steps:

- providing a movable insertion machine configured to arrange at least one insert in a fresh concrete block, the movable insertion machine being provided in a zone for producing prefabricated elements located near an installation zone intended to receive the railway track, the production zone being separate from the installation zone;
- pouring and shaping fresh concrete in order to form individual fresh concrete blocks having the predetermined dimensions;
- arranging at least one insert in each fresh concrete block using the movable insertion machine; and
- drying the fresh concrete blocks to obtain the prefabricated elements.

Owing to the use of the movable insertion machine, which can be moved and which is provided near the installation zone at the production zone of the prefabricated elements, the steps for pouring the concrete, shaping, and drying, and advantageously creating molds in order to form the concrete, are able to be carried out quickly and near the installation zone, without the latter necessarily being definitively ready to receive the railway track support.

Furthermore, this makes it possible to equip the prefabricated elements with the inserts quickly, prior to their installation at the installation zone. Thus, the prefabricated elements are able to be manufactured irrespective of the state of the installation zone and installed quickly at the installation zone once the latter is ready in order to obtain the railway track support, since they are pre-equipped and since the transport distances of the prefabricated elements are reduced.

Furthermore, the immobilization duration of the movable insertion machine in order to manufacture the railway track support is optimized and the mobile insertion machine can be moved so as to equip the prefabricated elements in several production zones or sites placed along the installation zone.

Lastly, the use of the movable insertion machine makes it possible to guarantee good positioning of the inserts and therefore rails of the railway track, for example including the inserts necessary for another rail that may be intended for the power supply or anti-derailment or guard rail systems, such that the alignment constraints of the rails are respected, following a previously established outline.

According to other advantageous aspects of the invention, the manufacturing method comprises one or more of the following features, considered alone or according to all technically possible combinations:

- after the step for drying the fresh concrete blocks, the method comprises the following step:
  - storing the prefabricated elements in the production zone;
- after the drying step, the method comprises the following step:
  - assembling the prefabricated elements at the installation zone in order to form the railway track support;
- before the assembly step, the method comprises the following step:
  - preparing the installation zone so that it has a globally planar surface for receiving the railway track support able to bear the weight of the railway track support and of a vehicle traveling on the railway track without undergoing deformation, and
  - during the assembly step, the prefabricated elements are positioned on the receiving surface;
- during the pouring and shaping step, a movable machine with sliding casings is used to form the fresh concrete according to a predetermined profile corresponding to the predetermined dimensions;
- during the pouring and shaping step, casings are used to form the fresh concrete according to a predetermined profile corresponding to the predetermined dimensions;
- during the arranging step, each insert is arranged in the corresponding fresh concrete block by vibrating the concrete around this insert during its movement, until it reaches a predefined position;
- after the drying step, the method comprises the following steps:
  - installing rails at the inserts; and
  - fastening the rails to the inserts using systems for fastening rails to the inserts.

The invention also relates to a railway track support made by implementing a manufacturing method as described above.

The invention further relates to a railway installation comprising a railway track support as described above and a railway track fastened to the railway track support at the inserts.

BRIEF DESCRIPTION OF THE DRAWINGS

The invention and its advantages will be better understood upon reading the following detailed description of one particular embodiment of the invention, provided solely as a non-limiting example, this description being done in reference to the appended drawings, in which.

DETAILED DESCRIPTION OF SOME EMBODIMENTS

Figure 1:
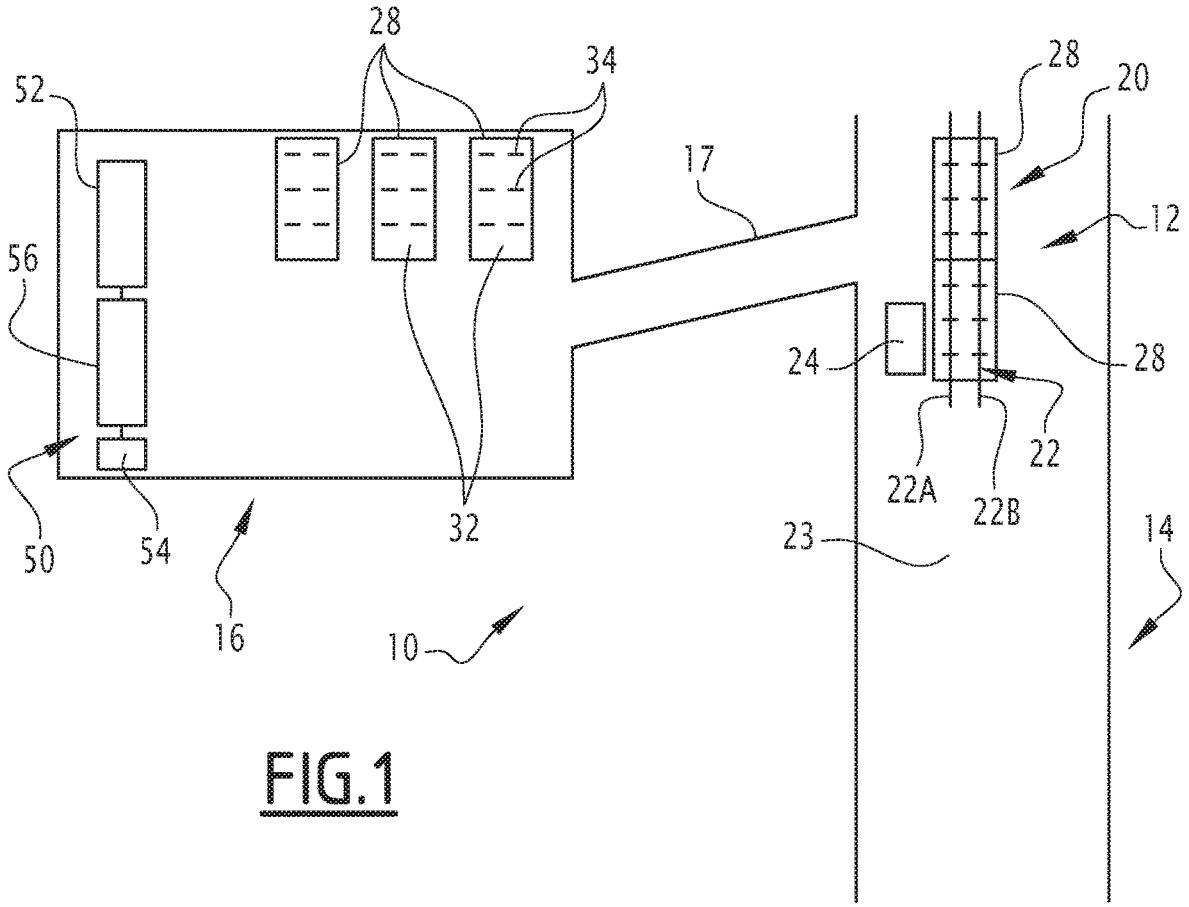
FIG. 1 is a schematic illustration of a space for accommodating a railway installation, the accommodating space comprising an installation zone intended to receive a railway track support obtained using a method according to one embodiment of the invention and a production zone for prefabricated elements forming the railway track support.

As shown in FIG. 1, the accommodating space 10 receiving the railway installation 12 comprises an installation zone 14 at which the railway installation 12 is intended to be placed and at least one zone 16 for producing elements belonging to the railway installation 12.

The accommodating space 10 also comprises a route 17 connecting the installation zone 14 and the production zone 16.

The railway installation 12 comprises a railway track support 20 and a railway track 22 comprising two rails 22A, 22B.

Advantageously, the railway installation 12 also comprises signaling and power supply means, not shown, for a railway vehicle traveling on the railway track 22.

The installation zone 14 is for example a zone reserved for the passage of a railway vehicle that is for example a tram, subway or train.

The installation zone 14 comprises a surface 23 for receiving the railway track support 20 and the railway track 22.

Advantageously, the installation zone 14 comprises a movable unit 24 for assembling the railway track support 20.

Advantageously, before placing the railway track support 20 in the installation zone 14, the receiving surface 23 is prepared, i.e., configured to be globally planar and able to bear the weight of the railway track support 20 and of a vehicle traveling on the railway track 22, without undergoing any deformation and following a defined outline.

The railway track support 20 comprises a plurality of prefabricated elements 28 with predetermined dimensions assembled to one another and systems 30 for fastening the railway track 22 to the railway track support 20.

The movable assembly unit 24 for example comprises means for lifting prefabricated elements 28 and is able to position the prefabricated elements 28 on the receiving surface 23 and to assemble the prefabricated elements to one another at the receiving surface 23 in order to form the track support 20.

Each prefabricated element 28 comprises a concrete block 32 having the predetermined dimensions and a plurality of inserts 34 secured to the concrete block 32 and able each to receive one of the rails 22A, 22B and the fastening system 30.

Each prefabricated element forms a slab for example having a length comprised between 2 meters and 10 meters, a width comprised between 2 meters and 5 meters, and a height comprised between 10 cm and 80 cm.

Figure 2:
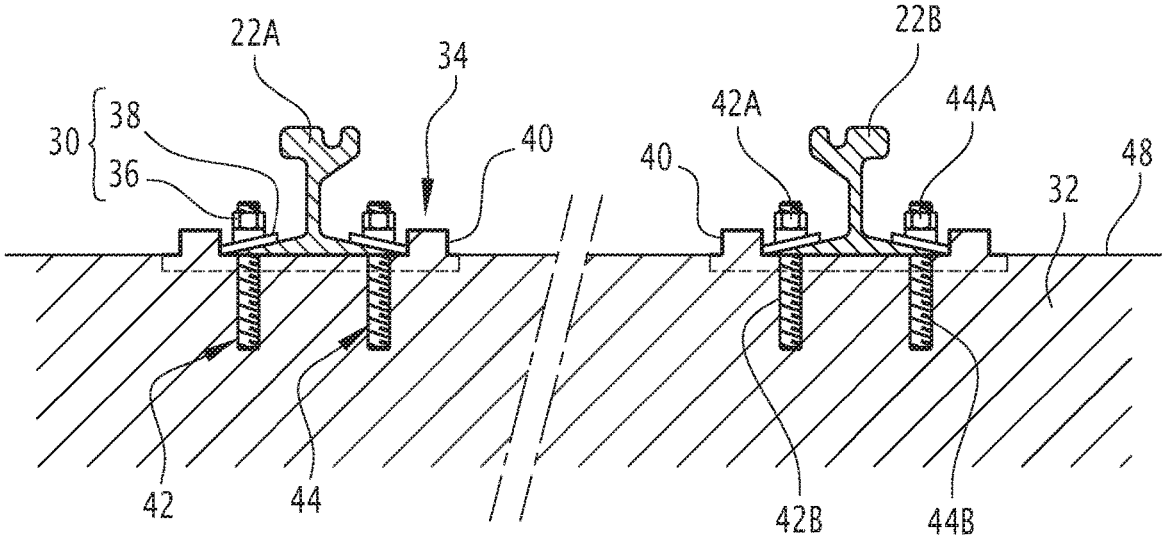
FIG. 2 is a sectional view of one of the prefabricated elements of FIG. 1 in a plane perpendicular to a longitudinal axis of the prefabricated element.
Figure 3:
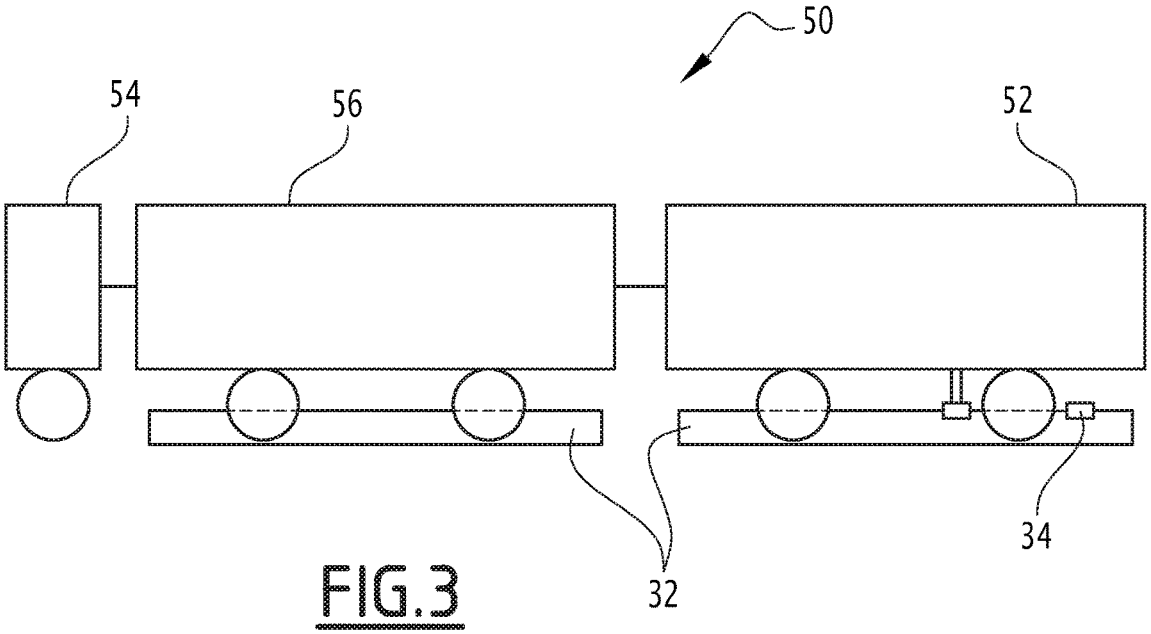
FIG. 3 is a schematic illustration of a convoy for manufacturing prefabricated elements comprising a movable machine for forming a fresh concrete block and a movable machine for inserting inserts in each fresh concrete block.
Figure 4:
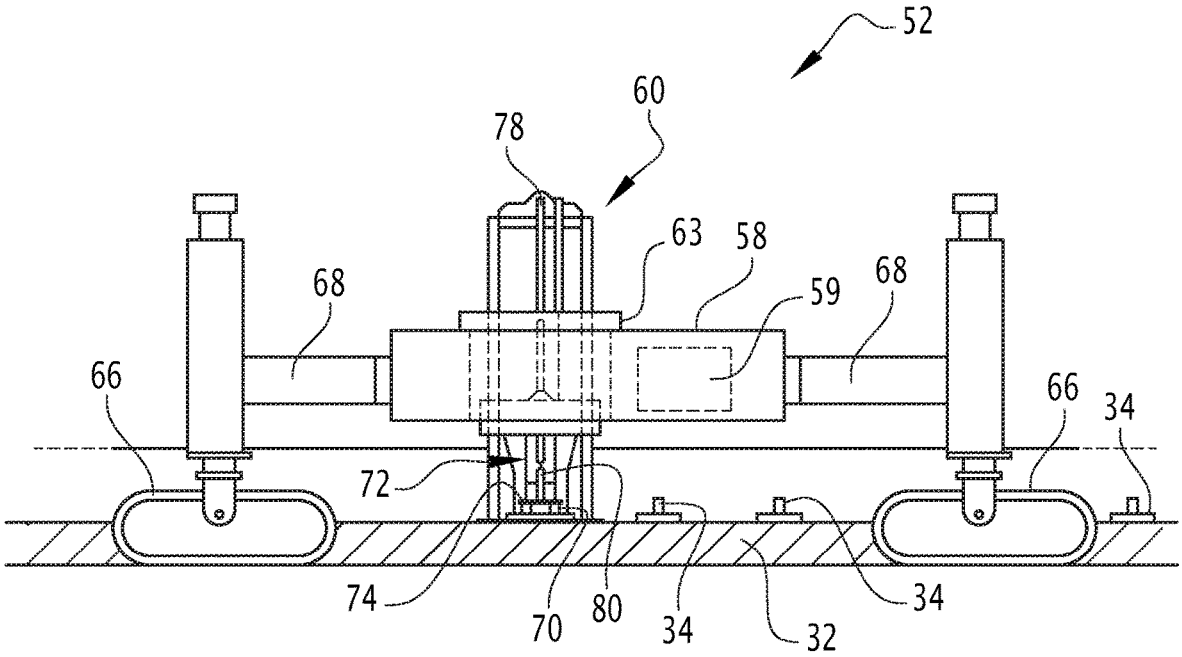
FIG. 4 is a side view of the movable insertion machine of FIG. 3.

Each fastening system 30 for example comprises, as shown in FIG. 2, nuts 36 and parts 38 inserted traditionally between each nut 36 and a base of the corresponding rail. Advantageously, the concrete block 32 comprises reinforcements, not shown, through which the concrete has been poured, then dried, such that the reinforcements are sealed in the concrete.

Each insert 34, also called tie plate, may or may not be made from metal and is sealed in the concrete of the corresponding concrete block 32 in order to transmit the forces exerted by the passage of a railway vehicle on the railway track 20.

Each insert 34 is for example as described in document EP 0,803,609 A2 page 4, left column, lines 1 to 37.

Each insert 34 for example comprises, as shown in FIG. 2, a stamped steel sheet metal or composite plate 40 and two or four studs 42, 44.

The studs 42, 44 each have a threaded shank respectively referenced 42A and 44A, making it possible to fasten a rail on the insert 34 via the fastening systems 30 and in particular the nuts 36 and an anchoring shank, respectively referenced 42B and 44B having a generally cylindrical shape, extending the threaded shank, and having asperities, circular for example, providing the retention in the concrete once the latter has hardened.

Alternatively, the studs comprise bolts making it possible to fasten a rail on the insert 34 and an anchoring sheath, for sealing in the concrete.

FIG. 2 shows a cross-section of the railway track support 20 and therefore a prefabricated element 28 once the latter is installed in the installation zone and rails 22A, 22B are fastened to the prefabricated element 28 via the fastening systems 30. In the example of FIG. 2, the rails are of the type with a groove.

FIG. 2 shows the two rails 22A, 22B respectively fastened on two inserts 34, by the nuts 36 and the parts 38 inserted between each nut 36 and the corresponding rail 22A, 22B. Advantageously, an altimetric wedge and/or a rail footing tie pad are inserted between the rails 22A and 22B and the plate 40.

The two inserts 34 are sealed in the concrete block 32, the surface of which is substantially planar or has a transverse slope, each of the two inserts 34 being pushed in through an upper face 48 of the concrete block 32 at a depth such that the plane of the inserts is approximately comprised in the plane of the upper face 48. The altitude of each of the rails 22A, 22B is determined on the one hand by the altitude of the upper face 48 of the concrete block 32, which is manufactured with a given precision of around several millimeters, and on the other hand depends on the pushing in of the insert 34 into the concrete of the concrete block 32.

The production zone 16 is separate from the installation zone 14 and is advantageously located near the installation zone 14.

The production zone 16 is for example located at a distance smaller than 5 km, preferably smaller than 500 meters, still more preferably smaller than 100 meters and greater than 10 meters from the installation zone 14.

The production zone 16 comprises a unit 50 for producing fresh concrete blocks 32 and a movable insertion machine 52 configured to arrange the inserts 34 in the fresh concrete blocks.

The production unit 50 for example comprises a movable concrete mixer 54 able to produce fresh concrete and a movable machine 56 for shaping the fresh concrete produced by the concrete mixer 54.

Alternatively, the fresh concrete is delivered by mixing trucks, concrete mixer, coming from a concrete plant outside the production zone 16.

Advantageously, the moving forming machine 56 and the concrete mixer 54 form a movable convoy.

The movable forming machine 56 is for example a machine with sliding formwork able to form, extrude the fresh concrete from the concrete mixer 54 according to a predetermined profile corresponding to the predetermined dimensions.

Alternatively, the production unit 50 comprises, in place of the movable forming unit 56, casings having the predetermined dimensions and configured to form the fresh concrete from the concrete mixer according to a predetermined profile corresponding to the predetermined dimensions.

The movable insertion machine 52 is configured to arrange each insert 34 in the first corresponding fresh concrete block once the fresh concrete has been formed by the production unit 50, preferably in a previously defined position.

The movable insertion machine is for example as described in EP 0 803 609 A2, columns 6 to 10.

Advantageously, the movable insertion machine 52, the movable forming machine 56, and preferably the concrete mixer form a movable convoy able to manufacture the prefabricated elements 28.

The movable insertion machine 52 comprises a movable platform 58 supporting two identical insertion devices 60 capable of inserting an insert 34 into each fresh concrete block 32, and a carriage 63 that is secured to the platform 58 receives the insertion devices 60 and is movable relative to the movable platform 58 along two horizontal axes, orthogonal to one another.

The platform 58 is for example mounted on four tracks 66 via four horizontal arms 68 that are advantageously articulated, making it possible to adjust the spacing between the tracks.

The position of the platform 58 is slaved along three orthogonal axes, using a control unit 59.

The platform 58 straddles the concrete blocks 32 and moves above the concrete blocks 32 owing to motors actuating the tracks 66.

The insertion devices 60 are separated by an interval corresponding to the interval provided for the rails 22A, 22B. The movable carriage 63 moves them together and makes it possible to refine the insertion position, with a precision of about one millimeter along two horizontal axes, even better than that procured by the platform 58.

Each insertion device 60 comprises a member 70 for gripping an insert 34, a member 72 for moving the gripping member able to move the gripping member so that the insert 34 comes into contact with a fresh concrete block 32 above which the insertion machine 52 travels and a vibrating device 74 able to vibrate the gripping member 70.

The gripping member 70 for example comprises clamps or suction cups.

The movement member 72 for example comprises one or several jacks 78 capable of setting a movable rod 80 in motion that is connected to the gripping member 70.

The vibrating device 74 comprises one or several vibrators, each vibrator for example being made up of a hydraulic motor having an unbalancing mass. The vibrating device 74 vibrates while driving the movement of the gripping means 70, which transmit the vibrations to the insert 34, and in particular to the studs 42, 44 of the insert. Under the action of these vibrations, the concrete is much more fluid near the anchoring rods 42B, 44B, which makes it possible to push them in with less force and to obtain much more precise positioning, while ensuring the proper coating of the various components of the insert in the concrete.

In an alternative that is not shown, the movable insertion machine 52 comprises a movable robotic arm connected to a structural element of the movable insertion machine 52. The robotic arm comprises means for gripping the inserts 34 and has at least 3 degrees of freedom, preferably at least 4 degrees of freedom relative to the structural element.

Figure 5:
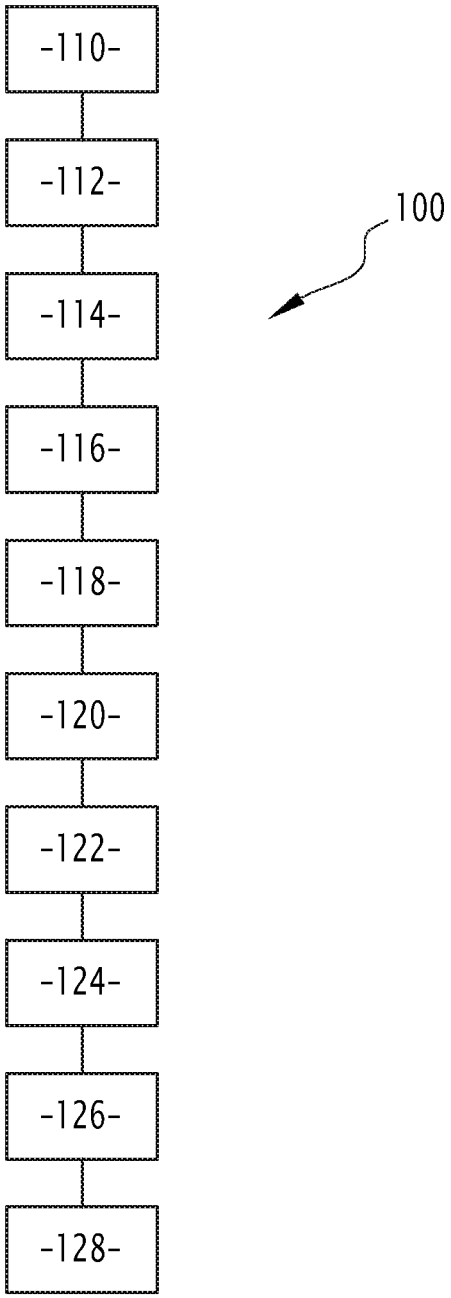
FIG. 5 is a flowchart of an example method for manufacturing the railway track support of FIG. 1.

The operation of the method for manufacturing the railway track support 20 will now be described using the flow chart 100 of FIG. 5.

In a first step 110, the production unit 50 and the movable insertion machine 52 are provided on the production zone 16.

Next, during a preliminary step 112, an appropriate concrete is prepared, using the concrete mixer 54 then loaded in the machine with sliding formworks 56.

Then, during a pouring and shaping step 114, the machine with sliding formworks 56 pours the concrete and forms it to obtain the fresh concrete blocks 32 with the predetermined dimensions.

For example, the machine with sliding formworks 56 comprises first right and left formworks to form the upper faces and the side faces of the concrete blocks 32. The height of the sliding formworks is adjusted before using the machine in order to profile the fresh concrete blocks 32 according to the predetermined dimensions.

Advantageously, the machine with sliding formworks 56 for example travels above prearranged reinforcements.

In a following insertion step 116, while the concrete is still fresh, the automatic insertion machine 52 travels above the fresh concrete blocks 28 so as to insert, in predefined positions, the fastening inserts 34 of the rails. In a known manner, the inserts 34 are inserted into the fresh concrete with a vibrating movement making it possible to push the anchoring shanks 42B, 44B into the concrete. More specifically, each insert 34 is arranged in the corresponding fresh concrete block by causing the concrete to vibrate around this insert 34 during its movement, until it reaches the predefined position.

Preferably, such an automatic insert insertion machine 52 comprises means making it possible, while the insert 34 to be inserted is driven by a vibrating movement, for the still-fresh concrete to retain the shape that has been imparted to it in step 114.

Next, during a drying step 118, the concrete blocks 32 are left to rest in order to dry. Once the concrete has set and is dry, the inserts are sealed in position and the prefabricated elements 28 are obtained. The insertion position is obtained with great precision owing to the insertion machine 52.

Advantageously, the prefabricated elements 28 are kept at a predetermined temperature and humidity, for example using a drying machine in order to complete the hardening of the concrete.

Then, during a storing step 120, the prefabricated elements 28 are stored in the production zone.

They are for example moved into a storage area provided to that end in the production zone 16.

Next, during a preparation step 122, the installation zone 14 is prepared so that the surface 23 for receiving the railway track support 20 is globally planar and able to bear the weight of the railway track support 20 and a vehicle traveling on the railway track 20, without undergoing any deformation.

Then, during a transport step 124, the prefabricated elements 28 are transported toward the installation zone 14 and, during an assembly step 126, the prefabricated elements 28 are assembled to one another or positioned side by side so as to form the railway track support 20.

Following the assembly step 126, during an installation step 128, the rails 22A, 22B are installed at the inserts 34 and fastened to the inserts 34 using associated fastening systems 30.

Advantageously, before the assembly step 126, portions of the rails 22A, 22B previously welded, as well as the fastening means 30, are stored at the installation zone 14 along the receiving surface 23, on either side of the receiving surface 23.

Also advantageously, after the installation step 128, the height of the rails 22A, 22B is verified and the fastening systems 30 of the rails are adjusted in order to adjust the height of the rails, then the prefabricated elements 28 are for example fastened to one another if necessary and to the receiving surface 23, for example using adjusting or leveling concrete or mortar.

The railway track support 20 obtained using the method described above is suitable for any type of transport vehicle such as a train, tram or subway.

Advantageously, the predetermined dimensions are calculated based on the use of the railway track support, i.e., for example based on a required alignment of the rails of the track, the speed and weight of the vehicles intended to travel on the railway track, as well as characteristics of the ground in the installation zone 14.

More specifically, the movable machine with sliding formworks 52 is for example configured to store the predetermined dimensions, which depend on the desired characteristics of the railway track 20.

Advantageously, several production zones 16 are provided along the entire installation zone 14.

The manufacturing method described in this application makes it possible to optimize the use of the insertion machine 52 and to avoid an immobilization of said machine 52 and the staff using it, for example related to a delay in the preparation of the receiving surface 23.

Furthermore, the installation speed of the railway track support 20 is improved, since many tasks are performed upstream and all that remains is to assemble the prefabricated elements 28 in order to manufacture the track support 20.

Furthermore, the use of machines with sliding formworks 56 and insertion machines 52 makes it possible to manufacture the prefabricated elements 28 near the installation zone 14 by using a mechanized process, irrespective of the preparation state of the installation zone 14.

Furthermore, the constraints related to the transport of the prefabricated elements 28 are reduced.

Additionally, the use of machines with sliding formworks 56 and insertion machines 52 can be done in a covered location sheltered from inclement weather.

Lastly, using a movable insertion machine 52 for the insertion of the inserts makes it possible to account for the alignment constraints related to the project and to guarantee proper positioning of the inserts.

Advantageously, during step 116, inserts for fastening a railway track power supply rail or anti-derailment systems are inserted in the blocks of fresh concrete.

The embodiments and alternatives considered above are able to be combined with one another to lead to other embodiments of the invention.

The invention claimed is:

1. A method for manufacturing a railway track support, the railway track support comprising a plurality of prefabricated elements with predetermined dimensions assembled to one another, wherein said method comprises:

providing a movable insertion machine configured to arrange at least one insert in a fresh concrete block, the movable insertion machine being provided in a production zone for producing the plurality of prefabricated elements at a location near an installation zone that receives railway track, the production zone being separate from the installation zone;

forming said fresh concrete block by pouring and shaping fresh concrete so that said fresh concrete block will be formed having the predetermined dimensions, and repeating said forming as needed in order to obtain a plurality of said fresh concrete blocks arranging at least one insert in each said fresh concrete block in the plurality of said fresh concrete blocks using the movable insertion machine; and drying the plurality of said fresh concrete blocks to obtain the plurality of prefabricated elements.

2. The method according to claim 1, wherein after drying the fresh concrete blocks, the method further comprises:

storing the prefabricated elements in the production zone.

3. The method according to claim 1, wherein after drying the fresh concrete blocks, the method further comprises:

assembling the prefabricated elements at the installation zone in order to form the railway track support.

4. The method according to claim 3, wherein prior to assembling the prefabricated elements, the method further comprises:

preparing the installation zone so that it has a globally planar reception surface for receiving the railway track support able to bear the weight of the railway track support and of a vehicle traveling on the railway track without undergoing deformation, and wherein during the assembling the prefabricated elements, the prefabricated elements are positioned on the receiving surface.

5. The method according to claim 1, wherein during forming said concrete block by pouring and shaping, a movable machine with sliding casings is used to form the fresh concrete according to a predetermined profile corresponding to the predetermined dimensions.

6. The method according to claim 1, wherein during forming said concrete block by pouring and shaping, casings are used to form the fresh concrete according to a predetermined profile corresponding to the predetermined dimensions.

7. The method according to claim 1, wherein during arranging at least one insert in each said fresh concrete block, each insert is arranged in the corresponding fresh concrete block by vibrating the concrete around this insert during its movement until it reaches a predefined position.

8. The method according to claim 1, wherein after the drying step, the method further comprises:

installing rails at the inserts, and fastening the rails to the inserts using systems for fastening rails to the inserts.

9. A railway track support obtained by implementing the method for manufacturing according to claim 1.

10. A railway installation comprising the railway track support according to claim 9 and a railway track fastened to the railway track support at the inserts.

* * * * *